US005199496A

United States Patent [19]

Redus et al.

[11] Patent Number: 5,199,496

[45] Date of Patent: Apr. 6, 1993

[54] SUBSEA PUMPING DEVICE INCORPORATING A WELLHEAD ASPIRATOR

[75] Inventors: Clifford L. Redus, Peterculter, Scotland; Peter L. Sigwardt, Katy, Tex.

[73] Assignee: Texaco, Inc., White Plains, N.Y.

[21] Appl. No.: 778,546

[22] Filed: Oct. 18, 1991

[51] Int. Cl.[5] ..... E21B 43/01

[52] U.S. Cl. ..... 166/366; 166/372

[58] Field of Search ..... 166/366, 372, 370, 335, 166/371, 52, 357; 417/151; 137/13

[56] References Cited

U.S. PATENT DOCUMENTS 3,977,469 8/1976 Broussard et al. ..... 137/13 X
3,980,138 9/1976 Knopik ..... 166/372 X
4,603,735 8/1986 Black ..... 166/372 X
4,705,114 11/1987 Schroeder et al. ..... 166/366 X
4,915,176 4/1990 Sugier et al. ..... 137/13 X
4,967,843 11/1990 Corteville ..... 166/372 X

*Primary Examiner*—Stephen J. Novosad
*Attorney, Agent, or Firm*—Jack H. Park; Kenneth R. Priem; Russell J. Egan

[57] ABSTRACT

A system is disclosed for subsea transportation of a hydrocarbon production stream utilizing a wellhead aspirator to reduce wellhead flowing pressure. By using the Bernoulli effect, a head is delivered to the flowing stream that enables the crude oil/water/gas fluid within the system to be moved farther distances than wellhead pressure alone would allow.

6 Claims, 1 Drawing Sheet

SUBSEA PUMPING DEVICE INCORPORATING A WELLHEAD ASPIRATOR

BACKGROUND OF THE INVENTION

1. Field of the Invention

The present invention pertains to a method and apparatus for transportation of hydrocarbons through subsea pipelines from producing oil and gas fields to gathering and treating facilities remote from the production fields.

2. The Prior Art

One of the biggest problems associated with offshore production of oil and gas is the transportation of hydrocarbon gas and liquid mixtures from subsea wells to production facilities, either on platforms or ashore, through subsea pipelines over distances greater than 10 to 15 miles. Among the problems which must be overcome are the pressure to move the oil and gas as well as to keep the pipelines open to flow. The cold of the subsea environment and/or inadequate flow rates can cause the build up of hydrates on the walls of the pipeline to eventually stop flow altogether. Without some mechanism to impart a pressure head to the oil and gas, it becomes impracticable to move significant volumes of oil and gas further than relatively short distances, on the order of less than a couple of miles. It is, of course, possible to provide the pipeline with subsea pumps. However, the costs of such pumps, which must be constructed to both operate in the harsh subsea environment as well as to handle multiphase flow, is very high raising substantial questions of the economies of pumps as a solution to the problem.

The oil and gas industry is investigating a number of systems having as a goal to achieve a pressure boost enabling the subsea movement of oil and gas over greater distances. The systems being studied include above mentioned subsea multiphase pumps, such as the PLC by Multiphase Systems of U.K., and conventional single phase pumps, such as the GA-SP pump by Goodfellow Projects of Houston, Tex. The latter pumps are somewhat less expensive than multiphase pumps, but they must be inserted into the pipeline after separation of the fluid phases to liquid and gas phases, with the liquid and gas phase streams subsequently being recombined before delivery into the transportation pipeline in multiphase flow.

SUMMARY OF THE INVENTION

Multiphase hydrocarbons are transported from subsea wellhead manifolds to remote production facilities, either on platforms or ashore, by means of an educing device which utilizes the Bernoulli effect to cause a pressure differential resulting in oil and gas movement toward the production facility. This enables an increase in the flow rate of oil and gas to compensate for a reduction in the flowing wellhead pressure. A lift gas is injected subsea into the fluid flow in a riser at the production facility. This lift gas both reduces the specific gravity of the flowing oil and gas and assists the fluids in moving upward along a riser to the production facility.

BRIEF DESCRIPTION OF THE DRAWING

The present invention will be described, by way of example, with reference to the single attached drawing in which.

DETAILED DESCRIPTION OF THE PREFERRED EMBODIMENT

Figure 1:
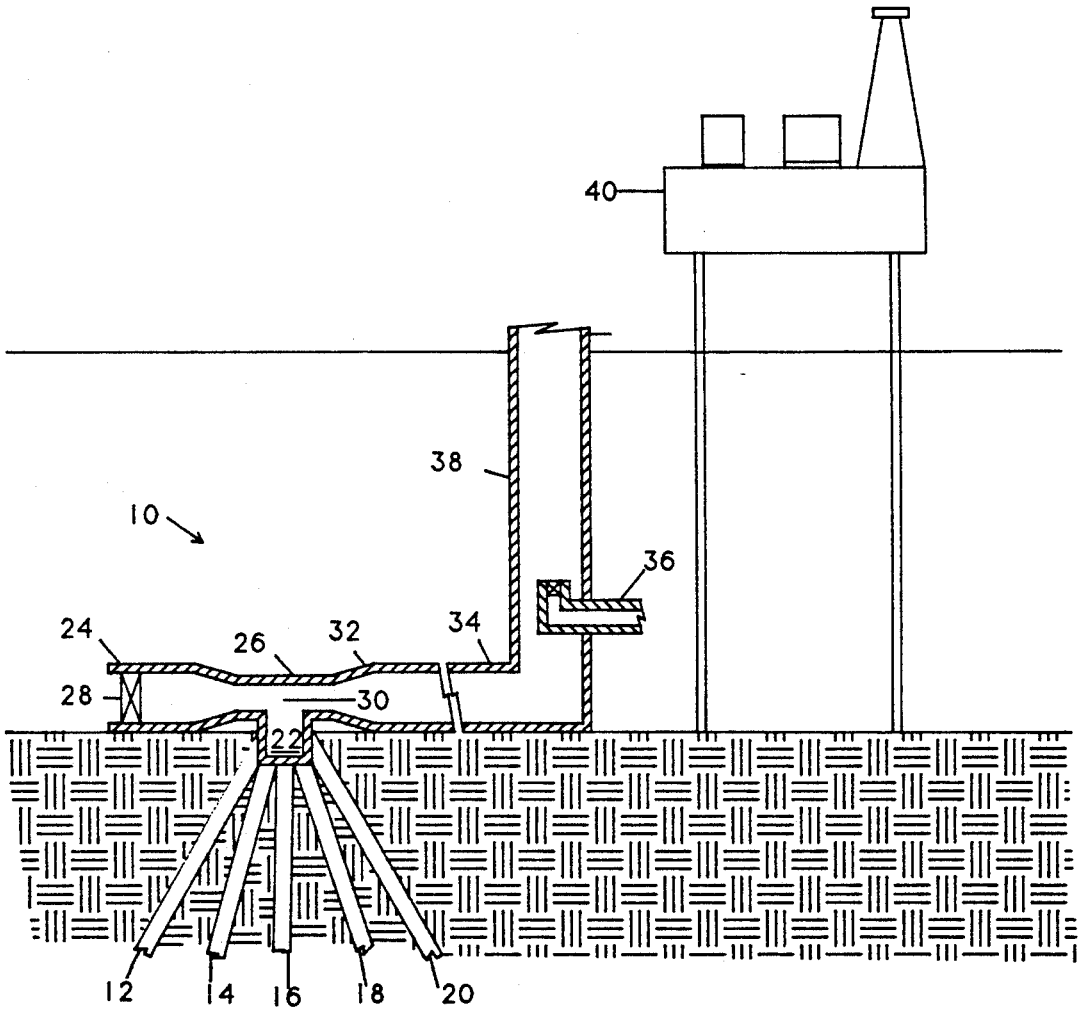
FIGURE 1 is a schematic diagram, in partial vertical section and not to scale, showing the present invention as it would be utilized to gather crude petroleum products from a producing subsea field and convey them to a remote production and treatment offshore platform.

Referring to FIG. 1, the subject invention 10 has been shown in conjunction with a subsea producing field in which a number of production wells 12, 14, 16, 18, 20 have been drilled, using known subsea drilling techniques, including slant and horizontal drilling, to penetrate hydrocarbon bearing formations (not shown). The wells each are provided with a known wellhead assembly (also not shown) with the production of the individual wells flowing to a production or gathering manifold 22. This manifold 22 must be located sufficiently close to the wellheads that there is no significant drop in fluid pressure between the wellheads and the manifold.

The subject invention 10 has an entrance 24 which provides an opening for sea water to flow into an aspirator 26. The flow of seawater is constrained to move only into the pipeline by the backflow preventer 28, preferably a one way check valve of known configuration. The diameter of the venturi throat 30 of the aspirator 26 is such that a significant reduction in pressure is achieved from the hydrostatic pressure of the sea water at the entrance 24. The bigger the inlet to throat diameter ratio, the larger the pressure drop will be. At the venturi throat 30, the aspirator 26 is connected to the subsea production wellhead manifold 22 located at the junction of pipes coming from a plurality of producing wells 12,14,16,18,20.

Subsea wellheads are incorporated in subsea trees, such as those built by Vetco Gray. Each subsea tree is different depending on the requirements of the field and/or the operator. These trees accomplish a number of tasks including: serving as a guide base to drill a well; providing valving to shut in flow lines in an emergency; providing rate control via chokes; providing valves to enable cross over between tubing and annulus; providing hydraulic control of subsea safety valves; providing a stable working platform to work over a well; and providing a mechanism to pull production tubing and casings from the well for repair.

Downstream of the commingling point in throat 30, the diameter of the aspirator 26 increases at 32 to that of the transportation pipeline 34, which can be on the order of up to 50 miles in length.

A conventional gas lift valve 36 is connected to a riser 38 which is connected between the above sea production platform 40 and subsea transportation pipeline 34. The valve 36 is connected to the production platform. The means making connection of the riser 38 and valve 36 to the platform 40 are well known and therefor have been schematically illustrated by a single line in order to keep the drawing simple.

The basic concept of sending gas through the lift valve 36 is that the lift gas is pumped from the platform 40 through the one way gas lift valve 36 and passes into the production oil and gas moving upwardly through riser 38. The lift gas lessens the specific gravity of column of fluid in the riser thus reducing the pressure loss between the sea bed and the surface. For a given liquid production rate, there is an optimum amount of lift gas necessary to most effectively lift the liquid.

FIGURE 1 serves to describe the theoretical calculations for a typical installation. A particular example would be for the Gulf of Mexico with the five oil wells 12, 14, 16, 18, 20 producing 30° API crude oil and located in about 3,000 feet of water. The production platform 40 would be located about 50 miles from the wells and also be in about 3,000 feet of water. With the reservoir pressures specified as 4,090 psia and holding the flowing platform pressure at 103 psig, the objective of the calculation is to determine the delivery flow rates of oil, water and gas. A simulation of such a setup indicates that the pressure drops from that of hydrostatic sea water, approximately 1333 psig at the sea water entrance point 24, to approximately 289 psig at the throat 30 of the aspirator 26. This reduced pressure enables each well to flow at about 2,875 barrels of oil per day, 1,232 barrels of water per day and 2.875 millions of standard cubic feet of gas per day. The pressure then increases to about 1,300 pounds per square inch gauge, due to an increase in cross sectional area of the pipeline at 32 which provides sufficient head to move the crude oil, water and gas across the 50 miles to the base of the production platform 40 where the pressure is approximately 731 psig. The pressure in the riser 38 then decreases to approximately 103 psig at the platform topside, due to frictional and hydrostatic losses. For this example, lift gas is introduced into the riser at 36, which includes a one way check valve, at rates sufficient to reduce the average specific gravity of the fluid above the gas inlet to about 30 lbs per cubic foot.

The limits for depth, distances, diameters etc. are all interrelated. The example shown is about the maximum distance for this technique. Engineering calculations would have to be performed for each specific application to size the inlet, throat and transportation pipeline components and set the lift gas rates. This system will only work within predominantly oil systems, namely, those with gas/oil ratios less than 800 standard cubic feet of gas per stock tank barrel of oil.

The present invention may be subject to many modifications and changes without departing from the spirit or essential characteristics thereof. The present embodiment should therefor be considered in all respects as illustrative and not restrictive of the scope of the invention.

We claim:

1. A method for achieving subsea transportation of hydrocarbons comprising:
   - providing at subsea wellhead terminus of at least one producing well, an aspirator having one end connected to a piping system extending to a remote production facility;
   - connecting said aspirator to said wellhead; and
   - opening said aspirator to hydrostatic sea pressure whereby a pressure differential is created enabling flow of oil and gas from said wellhead to said production facility.

2. A method according to claim 1 further comprising injecting lift gas into said oil and gas to lessen the specific gravity and aid in driving the fluid to the surface.

3. A system for moving hydrocarbons significant subsea distances comprising:
   - a subsea wellhead connected to at least one producing well penetrating into an oil bearing formation;
   - aspirator means connected to said wellhead;
   - pipe means connecting said aspirator means to a remote production facility;
   - one way means connecting said aspirator means to hydrostatic sea pressure, whereby the Bernoulli effect of said aspiration or means will cause a pressure differential enabling movement of oil and gas from said wellhead to said production facility.

4. A system according to claim 3 further comprising valve means connected to inject lift gas to fluid flowing in said system whereby the specific gravity of the fluid is reduced to aid it in reaching the production facility.

5. A system according to claim 3 wherein said production facility is an offshore platform.

6. A system according to claim 3 wherein said production facility is onshore.

* * * * *